US010770199B2

(12) United States Patent
Goodman

(10) Patent No.: US 10,770,199 B2
(45) Date of Patent: Sep. 8, 2020

(54) CONCENTRIC WIRELINE CABLE

(71) Applicant: Halliburton Energy Services, Inc., Houston, TX (US)

(72) Inventor: George David Goodman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/405,778

(22) Filed: May 7, 2019

(65) Prior Publication Data

US 2019/0267156 A1 Aug. 29, 2019

Related U.S. Application Data

(62) Division of application No. 15/305,333, filed as application No. PCT/US2015/058448 on Oct. 30, 2015, now Pat. No. 10,332,653.

(51) Int. Cl.

| | |
|---|---|
| ***H01B 7/00*** | (2006.01) |
| ***H01B 7/04*** | (2006.01) |
| ***H01B 11/18*** | (2006.01) |
| ***H01B 11/20*** | (2006.01) |
| ***H01B 13/016*** | (2006.01) |
| ***E21B 17/00*** | (2006.01) |
| ***E21B 17/20*** | (2006.01) |

(52) U.S. Cl.

CPC ..... *H01B 7/046* (2013.01); *E21B 17/003* (2013.01); *E21B 17/20* (2013.01); *H01B 11/18* (2013.01); *H01B 11/1847* (2013.01); *H01B 11/1895* (2013.01); *H01B 11/20* (2013.01); *H01B 13/0165* (2013.01)

(58) Field of Classification Search

CPC ... H01B 7/02; H01B 7/04; H01B 7/06; H01B 7/902; H01B 9/04

USPC ..... 174/102 R, 103, 105, 106 R, 108, 109, 174/110 R, 113 R, 115

See application file for complete search history.

(56) References Cited

U.S. PATENT DOCUMENTS

2005/0219063 A1* 10/2005 Viswanathan ..... G01V 1/52 340/854.9
2011/0075978 A1* 3/2011 Rose ..... H01B 3/302 385/102
2012/0227481 A1* 9/2012 Dorffer ..... H01B 7/226 73/152.03

* cited by examiner

*Primary Examiner* — William H. Mayo, III
(74) *Attorney, Agent, or Firm* — Chamberlain Hrdlicka

(57) ABSTRACT

A wireline system includes a control system, a downhole tool, and a wireline cable coupling the downhole tool and the control system. The wireline cable includes a plurality of conductors, which includes a core conductor and a concentric conductor disposed around the core conductor, wherein two of the plurality of conductors form a conductor pair, and wherein each of the plurality of conductors is configured to transmit power, data, or both, between the control system and the downhole tool. The wireline cable further includes one or more insulative layers, wherein at least one insulative layer is disposed between any two conductors.

7 Claims, 5 Drawing Sheets

CONCENTRIC WIRELINE CABLE

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

Many downhole oil and gas operations often utilize electronic tools, such as various types of wireline tools, which require power and communication capabilities. A wireline tools is typically disposed downhole and suspended via a wireline cable which provides power and communications to the tool. The downhole environment presents many limitations. One such limitation is related to form factor. As any given wellbore has limited space, the tools must be sized to fit suitable within the wellbore. This also limits the size of the wireline cable. Limiting the size of the wireline cable in turn limits power delivery and data transfer speeds.

As downhole tools become more and more sophisticated, the tools are able to and perform more functions and generate more and higher resolution data. The tools may also require more sophisticated controls and advanced software. This requires associated hardware to be able to support the increase in data. This creates a demand for improved power delivery and faster data transfer means while remaining within the physical constraints and requirements of the downhole environment.

BRIEF DESCRIPTION OF THE DRAWINGS

For a detailed description of the embodiments of the invention, reference will now be made to the accompanying drawings in which.

DETAILED DESCRIPTION

The present disclosure provides a wireline cable capable of providing higher power transfer and increased data communication rate to and from a wireline tool. Specifically, the present disclosure presents a wireline cable with concentric conductors, which better utilize the limited space available for power and data transfer, rather than grouped stranded wires found in conventional wireline cables. This means that the present concentric design can provide higher power transfer and increased data communication rates within the same amount of space as conventional wireline cables.

Figure 1:
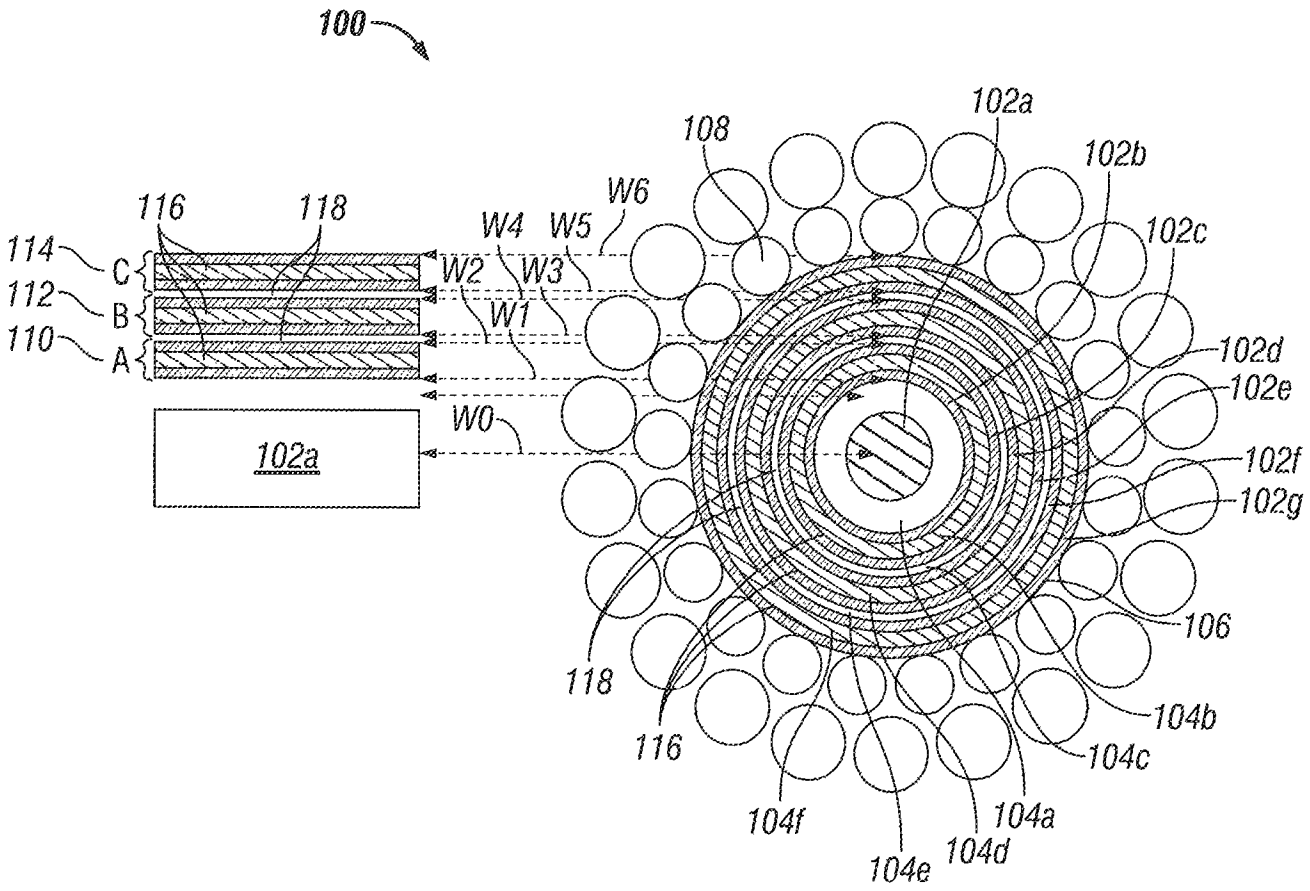
FIG. 1 is a cross-sectional view illustrating a wireline cable with concentric conductor.

Turning now to the figures, FIG. 1 shows a cross-sectional view of a wireline cable 100 with concentric conductors. The wireline cable includes a plurality of conductors disposed concentrically. Specifically, the wireline cable includes a core conductor 102*a* located in the center of the cable 100. The wireline cable includes a first insulative layer 104*a* disposed around the core conductor 102. The insulative layer 104*a* may be standard wire insulation. In some embodiments, the core conductor 102*a* and the first insulative layer 104*a* make up an insulated stranded wire. A second conductor 102*b* is disposed concentrically around insulative layer 104*a*, and another insulative layer 104*b* is disposed around the second conductor 102*b*. In some embodiments, a third conductor 102*c* is disposed concentrically around insulative layer 104*b*. In the illustrated embodiment, the wireline cable 100 includes a total of seven conductors 102*a*-102*g* concentrically disposed with an insulative layer 104*a*-104*f* disposed between every two consecutive conductors.

The wireline cable 100 includes an armor insulation layer 106 surrounding the outermost conductor 102*g*. In some embodiments, one or more armor layers 108 are disposed around the armor insulation layer 106, such as an inner armor steel wire 108*a* and an outer armor steel wire 108*b*. The armor insulation layer 106 may be a protective sheath or tape which protects the conductors 102 and thin enamel layers 118 from mechanical abrasion of the steel wire 108 as well as to provide electrical dielectric strength between the steel wire 108 and the underlying conductor build. In some embodiments, the armor insulation layer 106 is a polyethylene film tape. However, glass and Teflon based products may also be used. The armor layers 108 provide mechanical and structural support for the wireline cable 100. In some embodiments, the armor layers 108 may be used as a conductor.

The example embodiment of FIG. 1 and discussed above represents one possible implementation of the present disclosure and does not limit the scope of the disclosure. The 7-conductor wireline cable described above is suitable for many existing wireline systems. However, the wireline cable with concentric conductors disclosed herein can have any number of concentric conductors and insulative layer as well as other layers and materials suitable for specific implementations of the presently disclosed techniques.

The core conductor 102*a* can be a stranded conductor comprising a plurality of wire strands twisted together to form the conductor 102*a*. In some embodiments, the core conductor 102*a* and the insulative layer 104*a* may be provided integrally as an insulated stranded conductor. Stranded conductor as the core conductor 102*a* provides robust mechanical properties, tolerating bending, stretching, and relaxing over numerous well-run cycles. The wire gauge of the stranded conducted, and the insulation material and thickness of the insulative layer 104*a* can be selected depending the desired conduction drop and dielectric strength provided between the core conductor 102*a* and the other conductors in the cable 100. Selection of the insulation material may also depend on the mechanical robustness and temperature rating of the material with respect to that required for the application. In some embodiments, the core conductor 102*a* is replaced by a nonconductive cable, which provides increased mechanical strength rather than conductivity. The nonconductive cable may be fabricated from carbon fiber or other suitable materials.

Conductors 102*b*-102*g* have tubular shapes disposed around the core conductor 102*a* in increasing diameters. The conductors 102*b*-102*g* may be fabricated from a copper material or any other electrically conductive material. The increased surface area of the tubular conductors 102*b*-102 relative to solid wires provides greater conductance while taking up less space. Specifically, the concentric configuration of the conductors 102*b*-102*g* and interdisposed insulative layers 104*a*-104*f* allows each layer to conform directly to the inner layer, eliminating the wasted space that occurs when round conductors are bunched together side by side. Additionally, the increased conductance of the tubular shaped conductors 102*b*-102*g* provides greater bandwidth for communication as well as higher power transfer across the conductors 102*b*-102*g*. The ring thickness of each conductor 102*b*-102*g* can be selected based on the application and expected power and communication needs. For example, a ring thickness of three skin depths may be selected for lower communication frequencies.

In the illustrated embodiment of FIG. 1, of the seven conductors 102*a*-102*g*, six conductors are groups into three conductor pairs. Specifically, conductor 102*b* and conductor 102*c* form conductor pair A 110, conductor 102*d* and conductor 102*e* form conductor pair B 112, and conductors 102*f* and 102*g* form conductor pair C 114. The conductor pairs 110, 112, 114 can be used to deliver power or to enable high-speed data transmission.

In some embodiments, the insulative layer 104 between two conductors 102 of a conductor pair, such as between conductors 102*b* and 102*c*, includes a polymer ferrite layer 116. The polymer ferrite layer 116 is fabricated from a polymer ferrite material. The polymer ferrite is a flexible rubber material that is impregnated with magnetically permeable filler materials, such as ferrite dust. The polymer ferrite layer 116 may have relative permeability values from 9μ to 160μ. The polymer ferrite layer 116 can be fabricated to have a certain relative permeability value, optimizing the magnetic and mechanical properties for a target operating temperature range. Communication bandwidth typically increases with higher permeability and lower loss polymer ferrite materials. In an example embodiment, a polymer ferrite layer 116 may be made from a polyethylene resin filled with 3F4 ferrite dust yielding a net 110μ relative permeability. In other embodiments, the insulative layer 104 between two conductors 102 of a conductor pair may be made from a different magnetically permeable material such as Metglas, Nanocrystalline, Magnesil, Orthonol, Permolloy Supermalloy, Supermendur, and Silicon Steel based materials. Such materials provide permeability values from 1,000 to over 200,000.

In some embodiments, the insulative layer 104 between two conductors 102 of two different conductor pairs, such as conductors 102*c* and 102*d*, includes an insulating enamel layer 118. As the conductor pairs 110, 112, 114 may be used to deliver high voltage power downhole, dielectric regions between the conductor pairs 110, 112, 114 require insulating material that provides high dielectric voltage strength, low magnetic permeability, and low electric permittivity. High dielectric voltage strength allows for a thinner insulative layer, leaving a greater cross-sectional area for conductors 102 or polymer ferrite layers 116. Low magnetic permeability and low electric permittivity reduce undesirable cross-coupling between the conductor pairs 110, 112, 114. In some embodiments, the enamel layer 118 is fabricated from a polyimide resin that has a 240 degrees Celcius operating temperature rating with a dielectric strength of 2,000 volts per mil. Some other commercially available enamel materials that may be used in the insulating enamel layer 118 include formvar, polyurethane, polyurethane nylon, dacron glass, polyester-imide, polyester nylon, and polytetrafluoroethylene.

The wireline cable 100 embodiment illustrated in FIG. 1 is a seven conductor cable and can be used to many legacy wireline tools and systems. However, a wireline cable of the present disclosure can have more or less conductors and the conductors can be paired differently and not paired.

Figure 2:
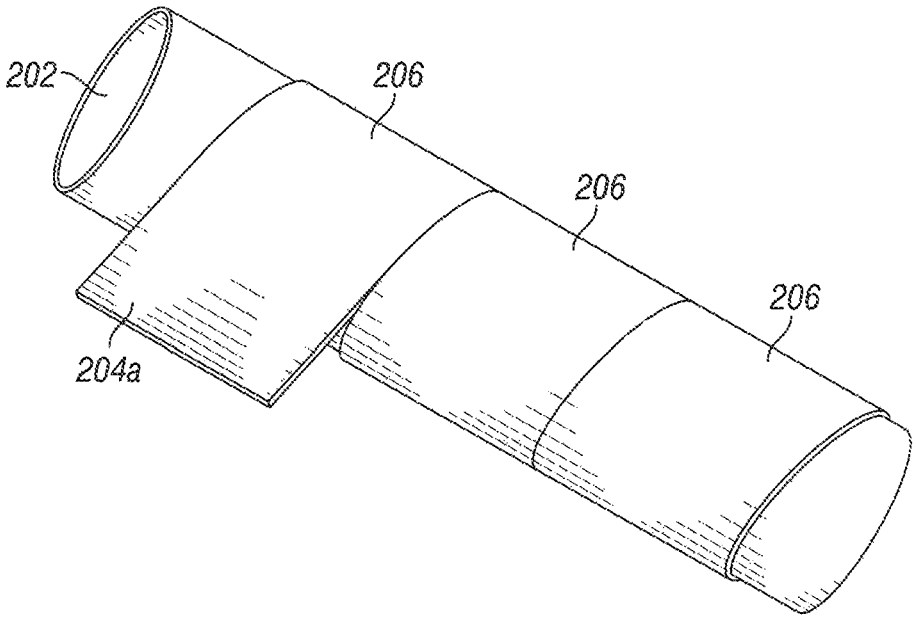
FIG. 2 illustrates the application of a polymer ferrite layer over an underlying cable build.

FIG. 2 illustrates an example application of the polymer ferrite layer 116 over an underlying cable build 202. The underlying cable build 202 includes any layers of the cable 100 disposed within the present polymer ferrite layer 116. For example, for the application of the polymer ferrite layer 116 of insulating layer 104*b*, the underlying cable build 202 comprises of the core conductor 102*a* and the first insulating layer 104*a*. In some embodiments, the polymer ferrite layer 116 fabricated from polymer ferrite in the form of a flexible tape, in which the polymer ferrite tape is helically wrapped around the underlying cable build 202. In some embodiments, each polymer ferrite layer 116 is made by helically wrapping one or more layers of polymer ferrite tape 204 around the underlying cable build 202, forming a plurality of wraps 206. FIG. 2 illustrates the application of a first layer of polymer ferrite tape 204*a*. The first layer of polymer ferrite tape 204*a* is wrapped around the underlying cable build 202 such as not to leave a gap at the seam between each wrap 206. In some applications, the polymer ferrite tape 204*a* may overlap itself between wraps 206.

Figure 3:
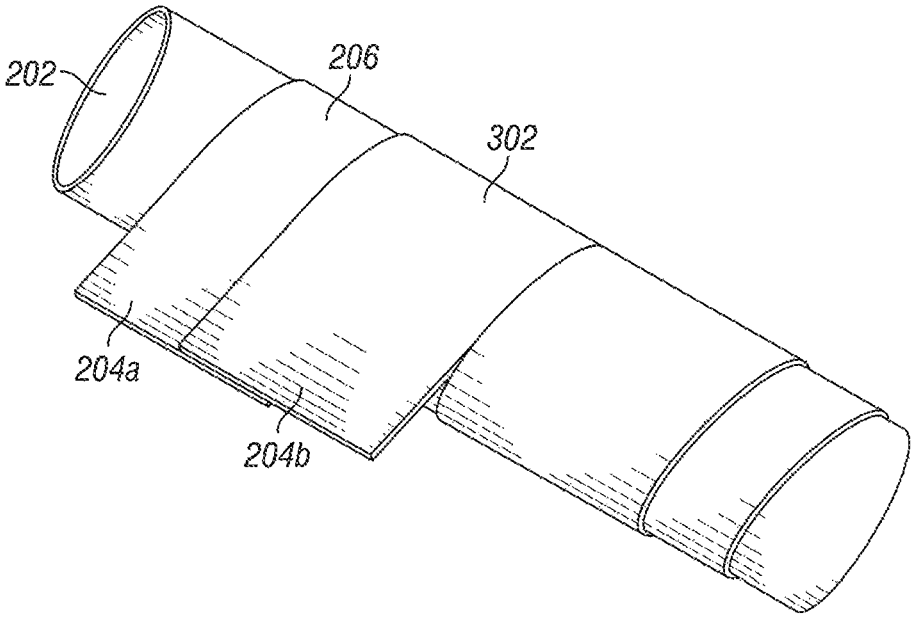
FIG. 3 illustrates the application of a second layer of polymer ferrite tape over a first layer of polymer ferrite tape.

FIG. 3 illustrates the application of a second layer of polymer ferrite tape 204*b* over the first layer of polymer ferrite tape 204*a*, forming a second layer of wraps 302. In the illustrated embodiment, the wraps 302 of the second layer of polymer ferrite tape 204*a* are shifted or offset from the wraps 206 of the first layer of polymer ferrite tape 204*a* by 50%. In other words, the second layer of polymer ferrite tape 204*b* covers the seams between the wraps 206 of the first layer of polymer ferrite tape 204*a*. This minimizes parasitic gap effects from impacting the magnetic flux path. The polymer ferrite tape 204 may be 0.01 inch thick. More or fewer layers of polymer ferrite tape 204 may be used and disposed around the underlying cable build 202 in various configurations, depending on the type of tape, resource limitations, and target specifications of each implementation.

Figure 4:
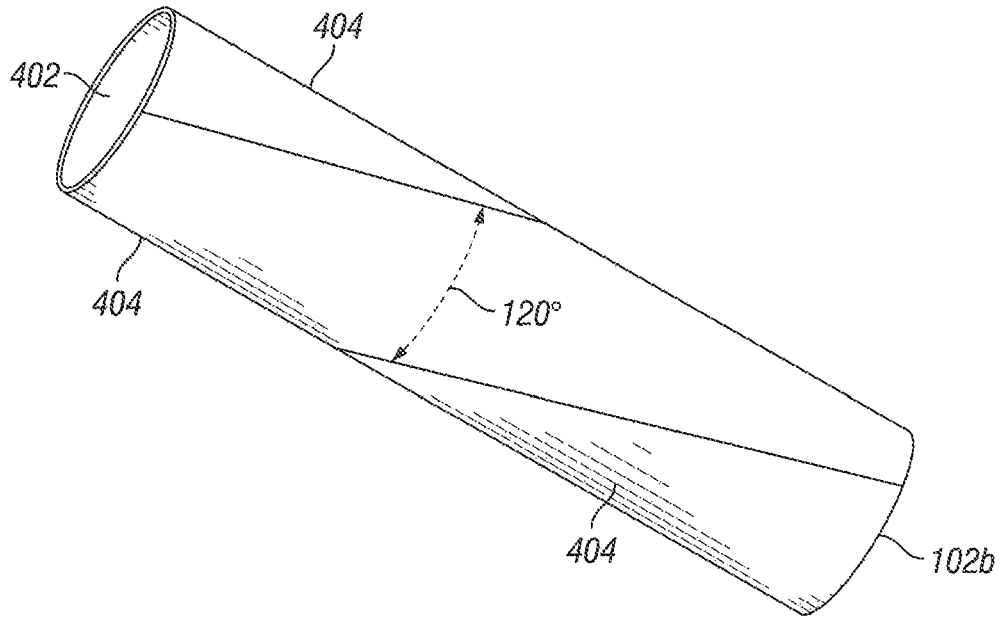
FIG. 4 illustrates the forming of a concentric conductor around an underlying cable build.

FIG. 4 is a perspective view of one of conductors 102*b*-102*g* (e.g., 102*b*) formed around an underlying cable build 402 of the wireline cable 100. In some embodiments, the conductors 102*b* can be formed by helically wrapping one or more conductive strips 404 around an underlying cable build 402. The conductive strips 404 may be fabricated from copper or other conductive material. In some embodiments, the conductors 102*b* is formed from three conductive strips 404 helically wound side by side around the underlying cable build 402. Each of the three conductive strips 404 may have a width spanning 120 degrees, or one-third, of the intended conductor circumference. In one such embodiment, the conductive strips 404 are wound with an approximate pitch of one turn every two feet along the length of the cable. However, the winding pitch can be selected so as to adequately support the load bearing stretch and contraction as well as bending of the cable 100 during use.

In other embodiments, the conductor 102*b* can be made from any number of conductive strips 404 formed in various configurations around the underlying cable build 402. Different conductors 102*b*-102*g* within the cable 100 can be formed differently. For example, a conductor with a larger diameter such as conductor 102*g* can be made from wider conductive strips 404 or a larger number of conductive strips 404 than a conductor with a smaller diameter such as conductor 102*b*.

Figure 5:
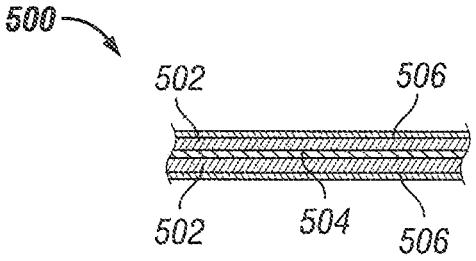
FIG. 5 is a cross-sectional view of a conductor pair strip.

In some embodiments, two successive conductors 102*b*-102*g* and the intervening enamel insulating layer 118 may be simultaneously formed by wrapping a preformed insulated conductor strip 500 around an underlying cable build. FIG. 5 illustrates a cross-sectional view of the insulated conductor strip 500. The insulated conductor strip 500 includes two conductive strips 502 with a layer of enamel coating 504 formed in between and around the two conductive strips 502. In one example, two conductive strips 502 are spaced apart by approximately 4 mil and the gap is filled with enamel coating 504. The enamel coating 504 may be formed between the conductive strips 502 through a dipping and degassing process in which the conductive strips 502 are dipped in enamel, removing all voids between the conductors and filling them with enamel In some instances, the conductive strips 502 are each 10 mil thick and the enamel coating 504 disposed therebetween is 4 mil thick. The dipping process may also leave, for example, approximately 0.5 mil of protective enamel coating on exterior surfaces 506 of the conductive strips 502. However, in other embodiments, the conductive strips 502 and the enamel coating 504 can be formed to other thicknesses suitable for the application.

In most applications, the two conductive strips 502 belong to conductors of two different conductor pairs 110, 112, 114. As the conductor pairs 110, 112, 114 may be used to deliver high voltage power downhole, dielectric regions between the conductor pairs 110, 112, 114 require insulating material that provides high dielectric voltage strength, low magnetic permeability, and low electric permittivity. Low magnetic permeability and low electric permittivity reduce undesirable cross-coupling between the conductor pairs 110, 112, 114.

Figure 6:
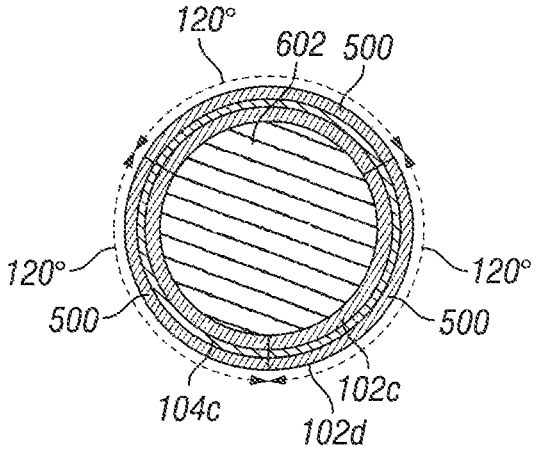
FIG. 6 is a cross-sectional view of three conductor pair strips wrapped helically side by side around an underlying cable build.

FIG. 6 illustrates a cross-sectional view of three insulated conductor strips 500 wrapped helically side by side around an underlying cable build 602, forming the two successive conductors (e.g., conductors 102*c* and 102*s*) and an insulating layer (e.g., insulating layer 104*c*). In such an embodiment, each insulated conductor strip covers 120 degrees of the intended arc length of the circumference. More or less than three insulated conductor strips 500 can be wrapped side by side. Thus, conductors 102*b*-102*f* may be formed by helically wrapping a single conductor strip 404 around an underlying cable build 402, building a single conductor layer as illustrated in FIG. 4, or by wrapping preformed insulated conductor strips 500 around an underlying cable build 602, building two conductor layers as illustrated in FIG. 6.

In some embodiments, each of the three insulated conductor strips 500 may be electrically isolated from each other such that each conductor 502 can carry an independent signal. Thus, one concentric conductor layer (e.g., 102*c*) can carry multiple independent signals, effectively increasing the number of conductors.

Figure 7:
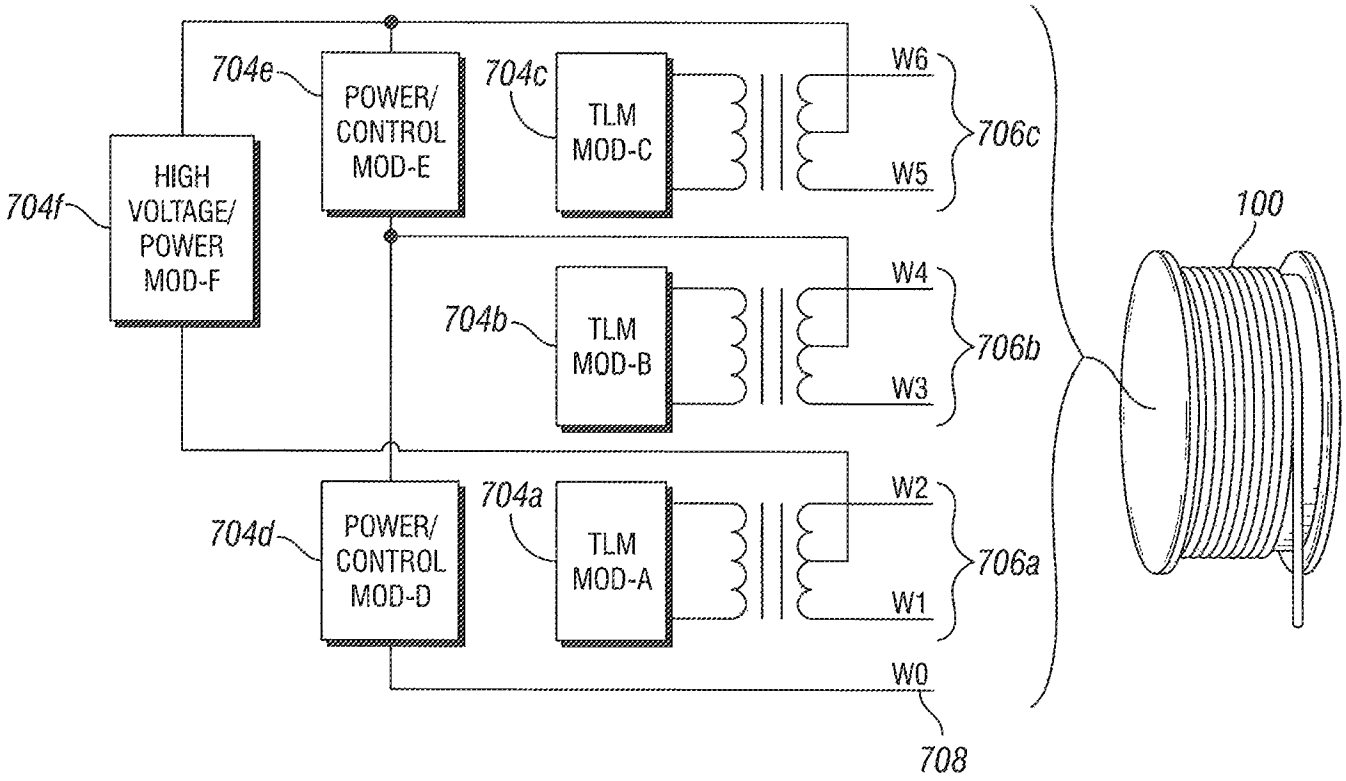
FIG. 7 is a schematic illustrating operational modes enabled by the concentric wireline cable.

FIG. 7 illustrates a schematic of operational modes enabled by the concentric wireline cable 100. In the illustrated embodiment, a seven-conductor wireline cable 702 is used to enable six modes. Mod-A 704*a*, Mod-B 704*b*, and Mod-C 704*c* are high-speed telecommunication modes, each of which is enabled by a conductor pair 706*a*, 706*b*, 706*c*, respectively. The high-speed telecommunication modes can be run simultaneously to maximize speed of data transfer. Mod-D 70*d* and Mod-E 704*e* are power sources configured to provide nominal AC power, DC power, low speed control signals, and/or sensor signals such as spontaneous potential. Mod-D 704*e* can be coupled to a core conductor 708 relative to a conductor pair (e.g., conductor pair 706*b*) and Mod-E 704*e* can be coupled to one conductor pair (e.g., conductor pair 706*b*) relative to another conductor pair (e.g., conductor pair 706*c*). Mod-F is a high voltage power source coupled between one conductor pair (e.g., conductor pair 706*a*) relative to another conductor pair (e.g., conductor pair 706*c*). The configuration of operational modes and conductor functions illustrated herein is one example of methods of utilizing the concentric wireline cable, and may be different in other applications.

The concentric configuration of the conductors in the concentric wireline cable as well as the helical formation of the conductor and insulating layers provides a number of advantages. The concentric configuration allows maximum usage of the space within a cross-section of the cable as the space can be fully dedicated to conductor and insulating layers with no wasted space. Additionally, the concentric orientation of the conductors allows for a greater overall cross-section for each conductor which enables increased transmission speeds and higher power transfer. The concentric and parallel orientation of the conductors provides a magnetic flux path between each of the conductor pairs, avoiding direct coupling between communication modes and induced eddy current losses. Furthermore, the electric flux density is uniform over the full circumference for each conductor due to the radial symmetry of the cable. The helical construction of the conductive and insulative layers allows the cable to bend and stretch while maintaining the mechanical and electrical integrity of the cable.

Figure 8:
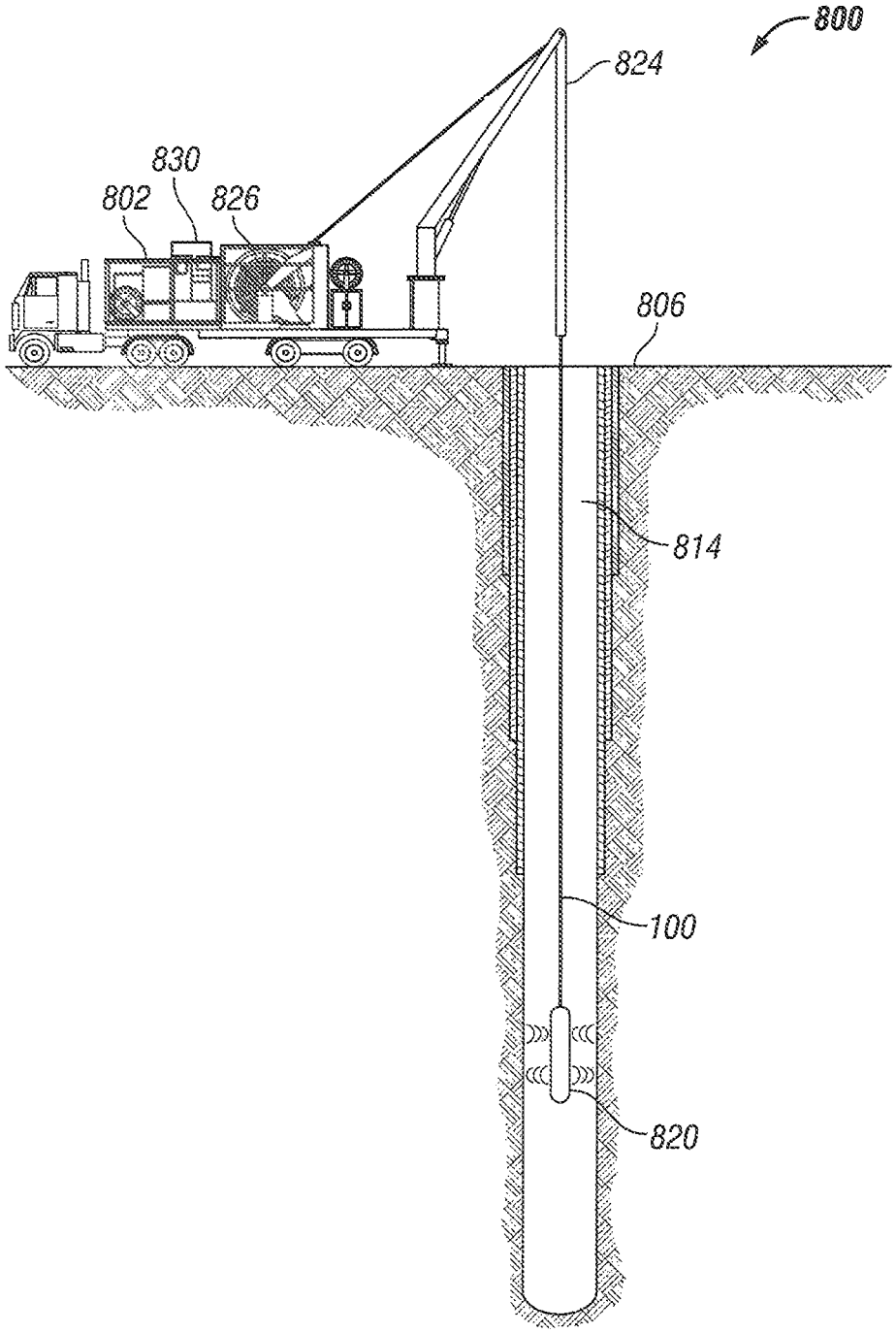
FIG. 8 illustrates an acoustic logging system with a concentric wireline cable and logging tool.

FIG. 8 illustrates an acoustic logging system 800 with a concentric wireline cable 100 and logging tool 820. The acoustic logging tool 800 is configured to obtain data regarding a well 814. In some embodiments, the concentric wireline cable 100 is suspended from a wireline truck 802 parked at the well site 106. The wireline truck 802 may include a wireline spool 826 which supplies the concentric wireline cable 100. The wireline truck 802 may also include a hoist 824 which suspends the concentric wireline cable 100 and acoustic logging tool 820 in the well 814. In some embodiments, the concentric wireline cable 100 and logging tool 820 may be suspended by various other well site structures such as a rig. In other embodiments, the acoustic logging tool 800 may be a pipe conveyed logging tool, which enabling logging of horizontal well sections.

In some embodiments, the logging tool 820 is configured to emit acoustic signals in the well 814 through the formation. The acoustic logging tool 820 then detects the returning acoustic data signal. The returning acoustic data signal is altered from the original acoustic signal based on the mechanical properties of the formation, such as compressional velocity, shear velocity, and the like. Thus, the acoustic data signal carries such information and can be processed to obtain the formation properties.

The concentric wireline cable 100 is coupled to a control system 830 which may be located on the wireline truck 802. The control system 830 provides power and instructions to the logging tool 820 and receives data from the logging tool 820, with the concentric wireline cable 100 enabling communication therebetween. In some embodiments, the control system 830 is located elsewhere near the wellsite 806.

In addition to the embodiments described above, many examples of specific combinations are within the scope of the disclosure, some of which are detailed below:

Example 1: A wireline cable, comprising:

at least one concentric conductor disposed concentrically around a core conductor, wherein the core conductor and the concentric conductor form a conductor pair; and an electrically insulative layer located between the core conductor and the concentric conductor.

Example 2: The cable of example 1, wherein the insulative layer comprises polymer ferrite, insulating enamel, or both.

Example 3: The cable of example 1 or 2, wherein the insulative layer is wrapped helically around the core conductor and concentric with the core conductor.

Example 4: The cable of example 1 or 2, wherein the concentric conductor comprises a conductive strip helically wrapped around the insulative layer.

Example 5: The cable of example 1 or 2, further comprising a plurality of concentric conductors, each having a different diameter, located concentrically around the core conductor.

Example 6: The cable of example 4, wherein the plurality of concentric pairs form one or more additional conductor pairs.

Example 7: The concentric wireline cable of example 5, wherein the conductors of at least one conductor pair are separated by a layer of insulating enamel.

Example 8: The cable of example 1 or 2, further comprising a load bearing armor wire located around the conductor and insulative layer.

Example 9: A method of manufacturing a concentric wireline cable, comprising:

providing an insulated core conductor;

helically wrapping a conductive strip around the insulated core conductor;

forming a conductor from the helically wrapped conductive strip;

helically wrapping an insulative strip around the conductor; and forming an insulative layer from the helically wrapped insulative strip.

Example 10: The method of example 9, further comprising:

providing a conductor pair strip, the conductor pair strip comprising two conductive strips separated by an insulating enamel; and helically wrapping the conductor pair strip around the insulative layer.

Example 11: The method of example 10, wherein the two conductive strips form a conductor pair.

Example 12: The method of example 9, wherein the insulative strip is a polymer ferrite material.

Example 13: The method of example 10, wherein the conductor pair strip is formed by degasing the two conductor strips in the insulating enamel, wherein the insulating enamel fills any space between the two conductor strips.

Example 14: The method of example 10, further comprising helically wrapping two or more conductor pair strips side by side around the insulative layer.

Example 15: The method of example 14, wherein each of the conductor strips are insulated from each other.

Example 16: A wireline system, comprising:

a control system;

a downhole tool; and a wireline cable coupling the downhole tool and the control system, the wireline cable comprising:

a plurality of conductors, comprising:

a core conductor; and a concentric conductor disposed around the core conductor, wherein two of the plurality of conductors form a conductor pair, and wherein each of the plurality of conductors is configured to transmit power, data, or both, between the control system and the downhole tool; and one or more insulative layers, wherein at least one insulative layer is disposed between any two conductors.

Example 17: The wireline system of example 16, wherein the control system comprises a power source, a transceiver, or both.

Example 18: The wireline system of example 16, wherein at least one of the insulative layers includes polymer ferrite, insulating enamel, or both.

Example 19: The wireline system of example 16, wherein at least one concentric conductor is formed from at least one helically wrapped conductive strip.

Example 20: The wireline system of example 16, wherein the two conductors of the conductor pair are separated by a layer of insulating enamel.

Example 21: The wireline system of example 16, wherein the conductors comprise six concentric conductors forming three conductor pairs, the three conductor pairs configured to simultaneously support high-speed data transmission.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A method of manufacturing a concentric wireline cable, comprising:

providing an insulated core conductor;

helically wrapping a first conductive strip around the insulated core conductor to form a first conductor;

helically wrapping an insulative strip around the first conductor to form a first electrically insulative layer, the first insulative strip comprising a magnetically permeable material.

2. The method of claim 1, further comprising:

providing a conductor pair strip, the conductor pair strip comprising a second and a third conductive strip separated by an insulating enamel; and helically wrapping the conductor pair strip around the insulative layer.

3. The method of claim 2, wherein the first and second conductive strips form a conductor pair.

4. The method of claim 1, wherein the insulative strip is a polymer ferrite material.

5. The method of claim 2, wherein the conductor pair strip is formed by degassing the second and third conductor strips in the insulating enamel, wherein the insulating enamel fills any space between the second and third conductor strips.

6. The method of claim 2, further comprising helically wrapping two or more conductor pair strips side by side around the insulative layer.

7. The method of claim 6, wherein each of the conductor strips are insulated from each other.

* * * * *